US008570189B1

(12) United States Patent
Casebolt

(10) Patent No.: US 8,570,189 B1
(45) Date of Patent: Oct. 29, 2013

(54) MULTIFUNCTION TRAFFIC CONTROL AND INFORMATION SYSTEM

(76) Inventor: Eric Casebolt, Tullahoma, TN (US)

( * ) Notice: Subject to any disclaimer, the term of this patent is extended or adjusted under 35 U.S.C. 154(b) by 325 days.

(21) Appl. No.: 13/103,542

(22) Filed: May 9, 2011

Related U.S. Application Data

(60) Provisional application No. 61/333,129, filed on May 10, 2010.

(51) Int. Cl.
*G08G 1/09* (2006.01)

(52) U.S. Cl.
USPC ..... 340/905; 340/907; 340/901

(58) Field of Classification Search
USPC ..... 340/905, 907
See application file for complete search history.

(56) References Cited

U.S. PATENT DOCUMENTS

| | | | | |
|---|---|---|---|---|
| 3,614,727 | A * | 10/1971 | Fritts | 340/905 |
| 4,361,202 | A | 11/1982 | Minovitch | |
| 5,771,484 | A | 6/1998 | Tognazzini | |
| 5,898,384 | A | 4/1999 | Alt et al. | |
| 6,101,750 | A | 8/2000 | Blesener et al. | |
| 6,104,313 | A | 8/2000 | Boyd, II | |
| 6,317,058 | B1 | 11/2001 | Lemelson et al. | |
| 6,392,558 | B1 * | 5/2002 | Schulmeyer et al. | 340/9.16 |
| 6,677,918 | B2 | 1/2004 | Yuhara et al. | |
| 6,690,292 | B1 | 2/2004 | Meadows et al. | |
| 7,095,337 | B2 | 8/2006 | Sudou et al. | |
| 7,098,805 | B2 | 8/2006 | Meadows et al. | |
| 7,098,807 | B2 | 8/2006 | Seguin et al. | |
| 7,167,106 | B2 | 1/2007 | Haase | |
| 7,382,276 | B2 | 6/2008 | Boss et al. | |
| 7,388,515 | B2 | 6/2008 | Hill | |
| 7,538,689 | B2 | 5/2009 | Haase | |
| 7,646,621 | B2 | 1/2010 | Kent | |
| 7,667,617 | B2 | 2/2010 | Lo | |
| 7,688,222 | B2 | 3/2010 | Peddie et al. | |
| 7,831,379 | B2 | 11/2010 | Nathan et al. | |
| 7,890,126 | B2 * | 2/2011 | Benco et al. | 455/466 |
| 2006/0142933 | A1 | 6/2006 | Feng | |
| 2007/0118395 | A1 * | 5/2007 | Haase | 705/1 |
| 2008/0018494 | A1 * | 1/2008 | Waite et al. | 340/907 |
| 2009/0141699 | A1 * | 6/2009 | Goshen et al. | 370/350 |
| 2011/0012751 | A1 * | 1/2011 | Jones | 340/825.69 |

* cited by examiner

*Primary Examiner* — Kerri McNally
(74) *Attorney, Agent, or Firm* — Waddey & Patterson, P.C.; Emily A. Shouse; Gary L. Montle

(57) ABSTRACT

A multifunction traffic control and information system of the present invention includes external condition sensors and various devices each having one or more display portions to display alphanumeric messages and a local communications module functionally linked to a local network. At least one device further includes a cellular communications module and a system controller. The controller receives a display data string including a message displayable by one or more of the devices, as transmitted from a remote source via a cellular network, determines at least one of the devices to display the message, and routes the message to at least one display portion associated with the one or more determined devices. The controller further generates a return data string based on external condition data sensed by the one or more sensors, and transmits the return data string across the cellular network to the remote source.

20 Claims, 4 Drawing Sheets

MULTIFUNCTION TRAFFIC CONTROL AND INFORMATION SYSTEM

CROSS-REFERENCES TO RELATED APPLICATIONS

This application claims benefit of the following patent application(s) which is/are hereby incorporated by reference: U.S. Provisional Patent Application No. 61/333,129, filed May 10, 2010.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to a device capable of receiving and publicly displaying information transmitted from a remote location. More particularly, this invention relates to an isolated device having a cellular modem capable of receiving cellular transmissions containing information for public display on one or more display channels.

Traffic display devices are conventionally used to provide important updated information to passing drivers. These devices may be used to provide notice of temporary conditions such as for example a reduced speed limit for an area presently under construction, or adverse weather conditions which require some degree of caution. These devices may further be used to advise of traffic conditions far ahead and at staggered intervals, such as one or more lanes of traffic being blocked or providing available detour information.

The temporary nature of the information that is often provided on such devices means that it is necessary to update the information frequently, such as changing weather conditions like fog or snow, but also typically for example where a certain reduced speed limit is required because construction workers are present during daylight hours, but where a normal speed limit would be acceptable during night hours when no workers are present. The remote locations in which the devices may typically be provided themselves means that the devices may not easily be adjusted manually. Further, where a number of devices are intended for interconnected but staggered use (e.g., widely dispersed in location along a particular roadway), it would be highly inconvenient for an individual or even a group of individuals to make the necessary adjustments on a frequent basis.

Conventional systems are available which transmit information to remote display devices via resources such as the Internet, Direct Connect (file sharing), RF (radio frequency) bidirectional communication, IR (infrared) data transmission, etc.

However, the technology is not presently available to provide full coverage to the entire range of locations in which such devices are needed. As but one example, a remote display device may be required or otherwise desirable for providing traffic information on a roadway bridge, and such bridges may often be of substantial length wherein no Internet coverage is presently available.

It is also often generally impractical to provide hard-wired communication links to remote display devices, particularly to a string of such devices which are related but require separate display messages, given the temporary and generally portable nature of these devices in for example construction applications.

Therefore, what is needed is a remote display device which can consistently receive wireless communications from a data source in substantially all locations where such a device may be needed, and is effective to publicly display information in accordance with the received data.

BRIEF SUMMARY OF THE INVENTION

In accordance with one aspect of the remote display device, wireless cellular communications may be provided between a cellular modem residing within a device housing and a remote cellular telephone. The wireless communications link may provide data which is translated into alphanumeric symbols and displayed by the display device. The cellular modem may provide significantly more convenient methods of communication with respect to, for example, Internet connections.

In other aspects, the display device may be configured to provide information for motorists in accordance with various traffic-related applications, such as for example speed limit adjustments, inclement weather notification, traffic accident notification and potential rerouting, "Amber alert" notifications, and abnormal traffic flow notification and potential rerouting.

The display device may be further configured to provide information for pedestrians in accordance with other applications, such as for example to notify and reroute users in airport or train terminals, college/university campuses, or other large public facilities such as museums, zoos, parks, etc.

In an embodiment, a multifunction traffic control and information device includes a housing, one or more external condition sensors, one or more display portions integral to the housing and effective to display alphanumeric messages, a cellular communications module residing within the housing and functionally linked to a cellular network, and a controller residing within the housing and operatively linked to the one or more sensors, the one or more display portions, and the communications module. The controller is configured to generate a return data string based on external condition data sensed by the one or more sensors, and to transmit the return data string across the cellular network via the communications module. The controller further receives a display data string transmitted from across the cellular network by a remote source via the communications module, the display data string further including an alphanumeric message displayable by at least one of the one or more display portions. At least one of the one or more display portions are determined or selected by the controller to display the message, and the controller routes the message to the at least one display portion.

One aspect of such an embodiment is that the received display data may further include encoded display data, wherein the controller may decode the encoded display data and route the decoded display data to the determined at least one display portion.

The controller may further route messages to the display portions based on external condition data sensed by the one or more sensors.

The controller may even further determine whether a message has been received via the cellular network, and route the received message or other messages based on the external condition data depending on the determination. Alternatively or in addition, the controller may compare external condition data sensed by the one or more sensors to a predetermined threshold value, and visually modify one or more displayed messages based on the comparison.

In another aspect, the device may include one or more multi-position switches residing within the housing, each switch associated with at least one of the display portions. The controller in accordance with this aspect determines a first or second switch state for each of the one or more switches, routes a predetermined message to a display portion when the associated switch is in a first state, and further routes messages in a received display data string to the display portion when the associated switch is in a second state.

The controller may further upon receiving a display data string including an address associated with a switch in a second state generate a return data string identifying the display portion associated with the switch as being locked, and transmit the return data string across the cellular network via the communications module.

In another aspect of such an embodiment, the device further includes a power supply residing within the housing to supply power to one or more of the controller, the display portions, the sensors and the communications module, and a power supply terminal coupled to the power supply and effective to receive charging power for the power supply from a power source. The power source may for example be formed of an array of solar cells coupled to the housing.

In another embodiment, a multifunction traffic control and information system in accordance with the present invention includes external condition sensors and various devices each having one or more display portions to display alphanumeric messages and a local communications module functionally linked to a local network. At least one device further includes a cellular communications module and a system controller. The controller receives a display data string including a message displayable by one or more of the devices, as transmitted from a remote source via a cellular network, determines at least one of the devices to display the message, and routes the message to at least one display portion associated with the one or more determined devices. The controller further generates a return data string based on external condition data sensed by the one or more sensors, and transmits the return data string across the cellular network to the remote source.

Another embodiment of the system in accordance with the present invention includes one or more external condition sensors, a plurality of slave devices each having one or more display portions effective to display alphanumeric messages and a local communications module functionally linked to a local network, and a master device having a local communications module functionally linked to the local network, a remote communications module functionally linked to a cellular network and a controller operatively linked to the one or more sensors. The controller is configured or otherwise effective to generate a return data string based on external condition data sensed by the one or more sensors and to transmit the return data string across the cellular network via the remote communications module. The controller is further configured or otherwise effective to receive a display data string transmitted from across the cellular network via the remote communications module, the display data string further comprising an address associated with one or more of the plurality of slave devices and a message intended for the devices, and to transmit the message to the one or more slave devices associated with the address.

DETAILED DESCRIPTION OF THE INVENTION

Figure 1:
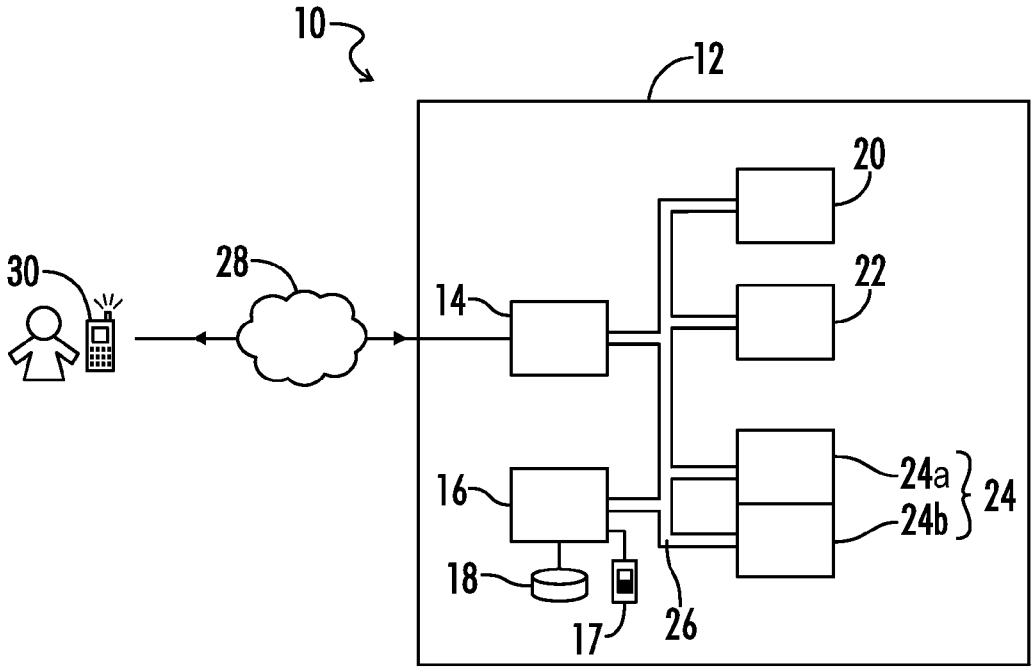
FIG. 1 is a block diagram representing an embodiment of a system in accordance with the present invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices.

The term "circuit" means at least either a single component or a multiplicity of components, either active and/or passive, that are coupled together to provide a desired function.

The term "signal" as used herein may include any meanings as may be understood by those of ordinary skill in the art, including at least one current, voltage, charge, temperature, data or a state of one or more memory locations as expressed on one or more transmission mediums.

Terms such as "providing," "processing," "supplying," "determining," or the like may refer at least to an action of a computer system, computer program, signal processor, logic or alternative analog or digital electronic device that may be transformative of signals represented as physical quantities, whether automatically or manually initiated.

Referring generally to FIGS. 1-4, various embodiments of a multifunction traffic control and information device and systems including the same are described herein. Where the various figures may describe embodiments sharing various common elements and features with other embodiments, similar elements and features are given the same reference numerals and redundant description thereof may be omitted below.

In an embodiment of the present invention as represented for example in FIG. 1, a device 10 is provided for remotely displaying information substantially in real-time, with the information being provided via a cellular communications network 28 from an information source 30 such as a portable communications device (e.g., cellular telephone) with a user interface linked to the display device 10. The device 10 may be located in association with a roadway for example such that the information provided may be traffic-related or otherwise relevant to passing motorists. The device location may be fixed or the device may be portably configured. The device as shown may further include a power source 20, one or more external condition sensors 22, one or more display portions 24*a*, 24*b* (or collectively 24), a remote communications module 14 and a controller 16.

In embodiments as shown, the above components may be coupled to each other by for example a physical communications bus 26, but alternatively certain components may be functionally linked by wireless, RF or the like. Certain components may further be formed of an integral component having various distinct features associated with the components, such as for example where embodied in a common integrated circuit or overlapping circuitry on a common printed circuit board or the like.

The controller 16 may be further coupled to one or more memory media 18 which may store for example data received from the external condition sensors and/or a look-up table containing alphanumeric display lines in association with a received code word, number or symbol.

The term "controller" as used herein may refer to at least a general microprocessor, an application specific integrated circuit (ASIC), a digital signal processor (DSP), a microcontroller, a field programmable gate array, or various alternative blocks of discrete circuitry as known in the art, designed to perform functions as further defined herein. The memory media 18 may further include at least one processor-readable memory medium 18. The term "processor-readable memory medium" as used herein may refer to any medium alone or as one of a plurality of memory media having instructions or the like residing thereon and which upon execution may provide data or otherwise cause a processor to implement subject matter or otherwise operate in a specific manner as further defined herein. It may further be understood that more than one type of memory media may be used in combination to conduct processor-executable instructions from a first memory medium upon which the instructions initially reside to a processor for execution.

The controller 15 may in an embodiment and without limitation further use the Android operating system, a mobile device platform known in the art which allows for open source applications. There are however many equivalent or alternative open source operating systems that could be used within the scope of the present invention, as would be known to a person having ordinary skill in the art.

The controller 16 may further be coupled to an array of multi-position switches 17 (e.g., DIP switches) which are associated with the display portions. The switches may be used for example to manually set device parameters such as default alphanumeric messages to be displayed by the display portions, or may set conditions for display of messages from various sources as will be further described below. In certain embodiments (not shown) the physical switches may be replaced or supplemented with an input terminal effective to receive commands from a user interface, such that a user may plug into or otherwise access the device and change one or more parameters.

The controller 16 may generally be configured or otherwise effective to receive a data string transmitted from across the cellular network 28 via the remote communications module 14, decode an alphanumeric message, determine at least one of the display portions 24 upon which the message is intended to be displayed, and appropriately route the message to the associated display portions. In various embodiments the coded display data string may include one or more addresses for each message which is intended to be displayed, with the controller effective to determine the one or more display portions based on the addresses. This determination may be made in accordance with predetermined addresses being associated with particular display portions, or the addresses may more generally relate to a location or size of the intended message to be displayed, wherein the controller may be effective to select one or more display portions as needed to accomplish the desired result.

The controller 16 may further be configured or otherwise effective to generate a return data string based on external condition data sensed by the sensors 22, and to transmit the return data string across the cellular network 28 via the remote communications module 14. The controller 16 may submit the return data string in encoded form or may rather submit a straightforward alphanumeric text message to for example a cell phone of a predetermined recipient. The recipient may be the same for each return data string, such as for example an individual or a remote computer effective to receive, decode and store the messages, or the recipient may be determined by the controller in accordance with the content of the return data string. For example, where a median traffic speed over a predetermined period of time may be sensed to have fallen below a threshold value a first recipient may be contacted by the device (such as a remote traffic controller who may take additional action if the slow speed indicates an emergency condition rather than normal rush-hour congestion), while in the event that a single speed measurement is taken above a second threshold value a second recipient may be contacted (such as a law enforcement officer further ahead).

The power source 20 in various embodiments may be any integrally mounted and independent power source such that the device 10 may be remotely and portably located without the need for an external line power supply. Such a power source may include one or more of various types of batteries as known in the art, including without limitation batteries of finite charge and renewable power sources such as those of distributed energy harvesting systems which generate power from an array of solar photovoltaic cells or wind energy using integral power converters. Alternatively, in various embodiments the display device may be configured to accept AC or DC voltage from an external line power source where available, either as a sole source of power or to supplement the integral power source. In certain embodiments the power source may further include a large capacitor effective to store energy while power is externally supplied to the device and to discharge sufficient energy to the device when the external supply is removed such that the device may transmit a message to the remote source indicating the loss of primary power.

In various embodiments the one or more external condition sensors 22 may be integrally mounted within or upon the housing 12 of the remote display device 10, or may optionally be remotely positioned with respect to the housing of the remote display device (not shown), and generally may be electrically coupled or otherwise functionally linked to the controller. The one or more sensors 22 may include without limitation sensing devices or circuits as are known in the art which may be configured to detect environmental conditions such as day/night, temperature, or air pressure, battery conditions or associated status, velocity conditions of approaching vehicle(s) (e.g., radar), housing breach conditions such as may result from external tampering or theft (e.g., tilt switches) or potentially from adverse weather conditions. The device may further include for example a global positioning system (GPS) receiver (not shown) to allow tracking in case of theft.

In various embodiments the one or more display portions 24 may be integrally mounted within the housing 12 of the display device 10 or may be modular units which are externally mounted upon the housing 12 or within for example apertures in the housing 12. One or more display portions 24 may be provided which maintain fixed text or graphical information, but it may generally be understood within the scope of the present invention that at least one display portion 24 may be provided which is configured to display a text or graphical message in accordance with data transmitted by the controller 16 to the display portion 24. The display portions 24 may without limitation include various forms of electronic visual displays as known in the art for direct view or projection display and which may be viewable by parties passing or otherwise within view of the display device 10, such as in but one example an arrangement of light-emitting diodes (LEDs).

It may be understood that in various embodiments a particular display portion 24*a* may be configured to display numerical information such as for example a speed limit, another display portion 24*b* may be configured to display text information such as for example a traffic notification, and another display portion 24*c* may be configured to display graphical information such as for example a directional indicator or even a figure indicative of construction workers ahead.

In various embodiments the one or more display portions 24 may be further configured to display numerical, text or graphical information in any of a plurality of selectable colors. The selected color may for example be indicated directly within the display data sent from the information source 30, or may automatically be selected in accordance with predetermined selection algorithms based on the received display data, stored instructions and/or for example predetermined settings which may for example be provided from the array of switches 17. The controller 16 may be configured to compare external condition data to a predetermined value and to visually modify one or more displayed messages based on the comparison and further in accordance with the switch settings, etc., where applicable. For example, a speed limit indication above a certain level may be automatically indicated with a particular color, while a speed limit indication below a different level may automatically be associated with a different color. A measured speed above a predetermined threshold value (e.g., more than a predetermined amount greater than the indicated speed limit) may trigger the controller to cause the displayed speed limit value to flash on and off.

Any combination and number of display portions may be anticipated with regards to a particular remote display device, and not all display portions associated with a particular remote display device may necessarily be used at any given time. The controller 16 may in various embodiments be configured upon receiving a display data string containing a message intended for particular display portions to determine a first (e.g., ON) or a second (e.g., OFF) switch state for each associated switch. Based on an ON state, the controller may simply (continue to) route a predetermined message stored in the memory medium to the associated display portion, but may otherwise when OFF route the received message forward and replace the previous message (or lack thereof). The controller may in various embodiments be configured to generate a return data string when the message is prevented from being displayed which includes an identifier for the one or more display portions associated with an OFF switch setting, and to transmit the return data string to a remote recipient across the cellular network via the remote communications module.

It may be understood that an almost limitless array of combinations are available for programming of the messages and associated visual conditions, based on the switch settings and received display data strings. For example, a first switch 17*a* may be set to cause a first display portion 24*a* to be blank (or alternatively stated to cause the controller 16 to not provide signals to the first display portion 24*a*) until a display data string is received from the remote source 30 and which contains an alphanumeric message intended for the first display portion 24*a*. A second switch 17*b* may be set to cause a second display portion 24*b* to display a predetermined alphanumeric message until overridden by a display data string received from the remote source 30 which contains an alphanumeric message intended for the second display portion 24*b*. A third switch 17*c* may be set to cause a third display portion 24*c* to display a sensed external condition (such as for example the temperature, vehicle speed, time, etc.) until overridden by a display data string received from the remote source 30 which contains an alphanumeric message intended for the second display portion 24*b*. Switches may be provided and configured to cause the controller to display only predetermined messages and to prevent received messages from being displayed on one or more of the various display portions, such as for example where a traffic emergency condition is detected. Switches may be provided and configured to cause the controller to rotate messages on a particular display portion between for example a received message from the remote source, a predetermined message stored in the memory medium and/or sensed external conditions.

The cellular communications module 14 may generally include a cellular data modem effective to receive and transmit data across the communication link 28 (e.g., cellular network 28) to an associated remote device. The communication link may include without limitation Radio Frequency, Direct Connect (wire or fiber), Cell Phone, Infrared, or an alternative standard communication link such as "Blue Tooth" or "Ethernet," and may generally be considered to include any intermediary devices, stations, or the like so as to facilitate and complete the data communications.

Figure 2:
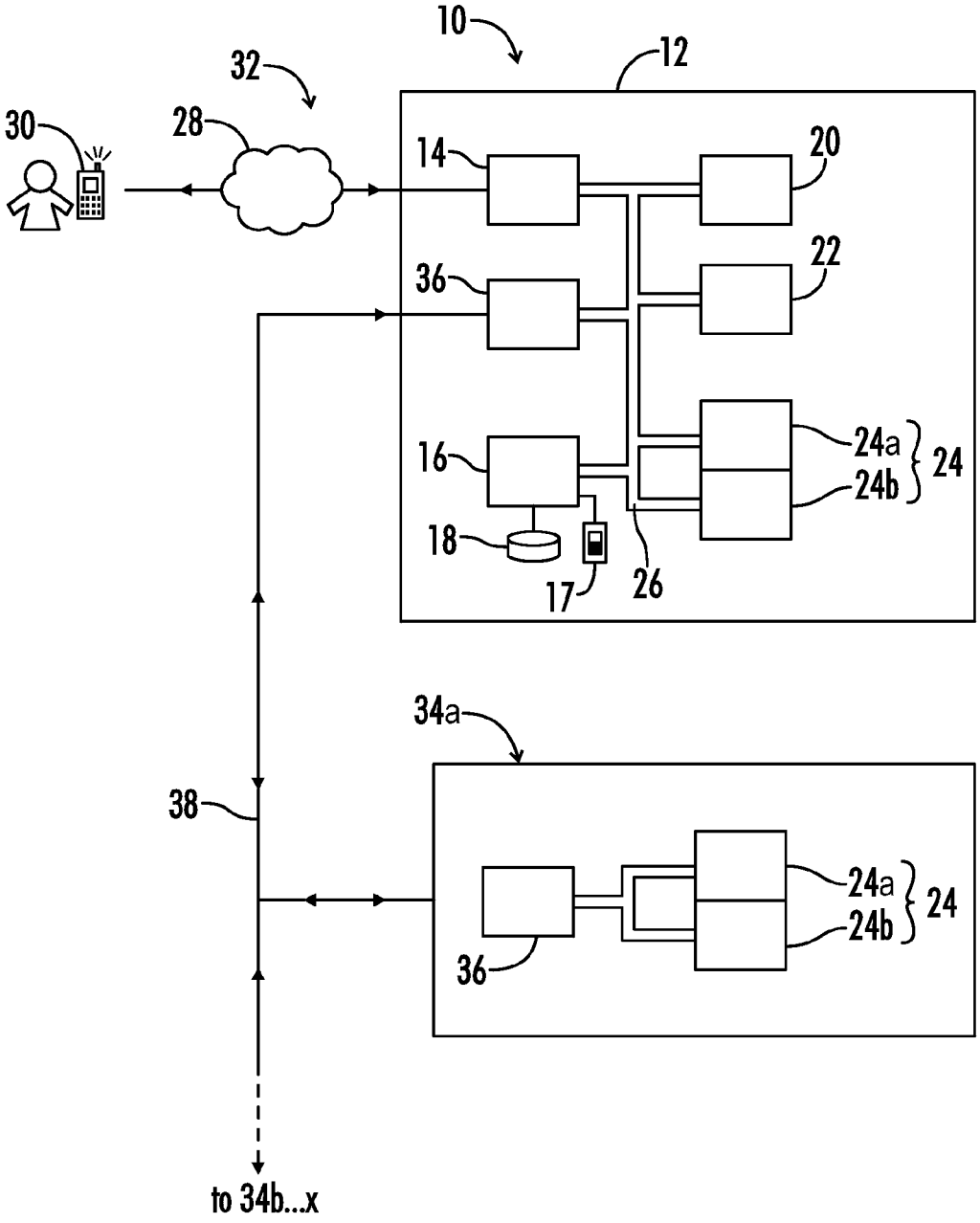
FIG. 2 is a block diagram representing another embodiment of a system in accordance with the present invention.

Referring now to an embodiment as represented in FIG. 2, a multifunction traffic control system 32 in accordance with the present invention includes a master display device 10 and one or more slave devices 34. The master display device 10 may be defined substantially as previously described with respect to the embodiment of the display device 10 represented in FIG. 1, but further including a local communications module 36 by which the master display device 10 may receive and transmit data to and from slave display devices 34. The local communications module 36 may be for example an RF transceiver, data port, or the like whereby the master display device 10 may receive data from an information source 30 via a cellular communication link 28 and subsequently transmit the data via a local communications network 38 (e.g., radio transmission, LAN, WAN, etc.) to one or more additional remote display devices 20.

The controller 16 in master display devices 10 may be configured to transmit return data from the remote communications module 14 to the local communications module 36 over the communications link 38, either at predetermined time intervals, by request of one or more slave devices 36 via the local communications module 36, or in response to various alternative triggers as may be anticipated within the scope of the present invention.

Figure 3:
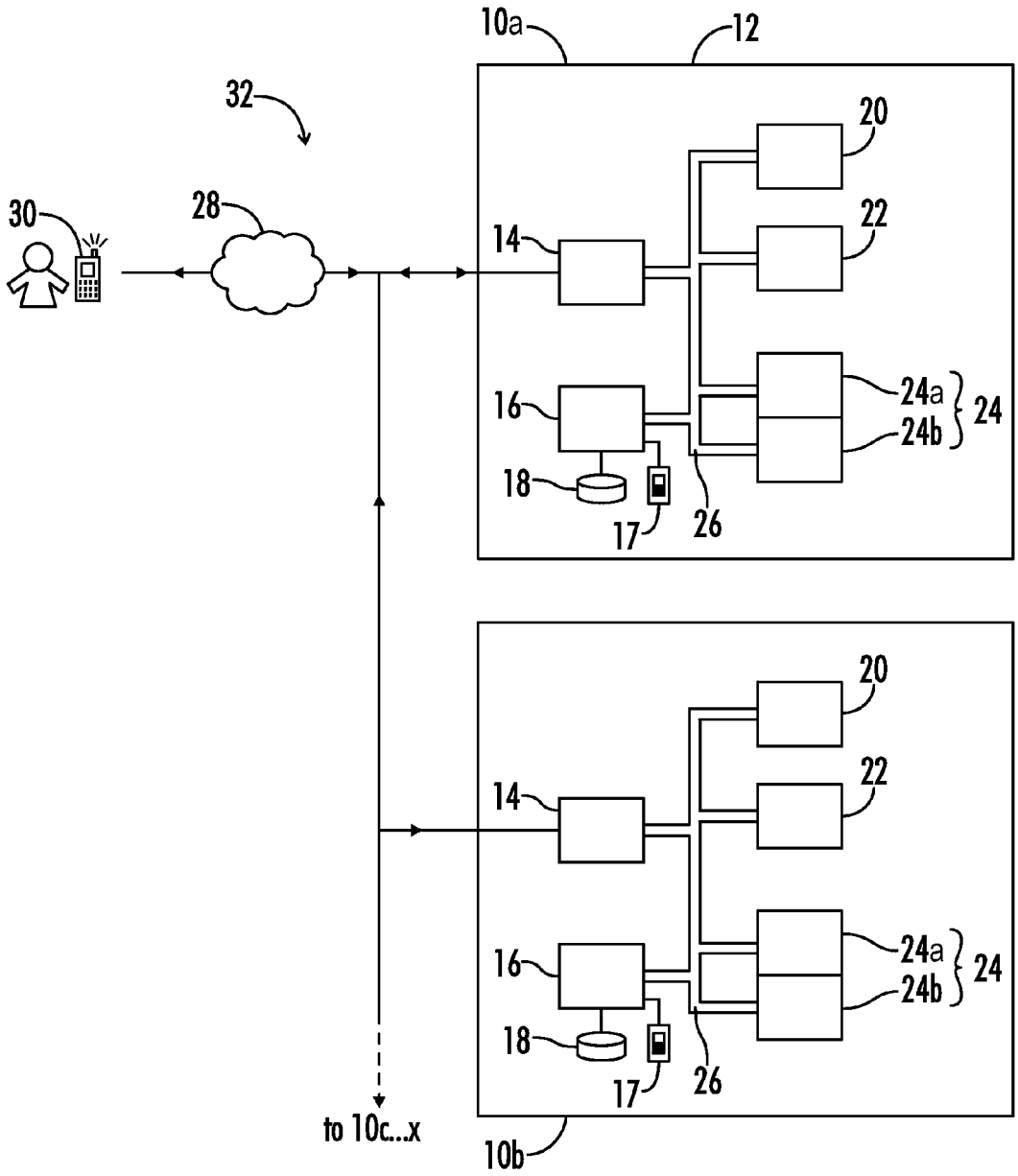
FIG. 3 is a block diagram representing another embodiment of a system in accordance with the present invention.

In accordance with various embodiments so described, a plurality of remote display devices 10, 34 may be disposed along a particular stretch of roadway, wherein a master display device 10 may receive a message indicating for example a first speed limit, and may automatically transmit the same message indicating various alternative speed limits for display by the other remote display devices 34. This method thereby lessens the need for a plurality of remote display devices which independently require cellular communications to update the displayed messages, although such a configuration is also within the scope of the present invention as represented in FIG. 3. Here, each device 10*a* . . . 10*x* defines an independent remote display device effective to receive display data strings directly from the remote source via the cellular network 28 and display the contained messages.

Figure 4:
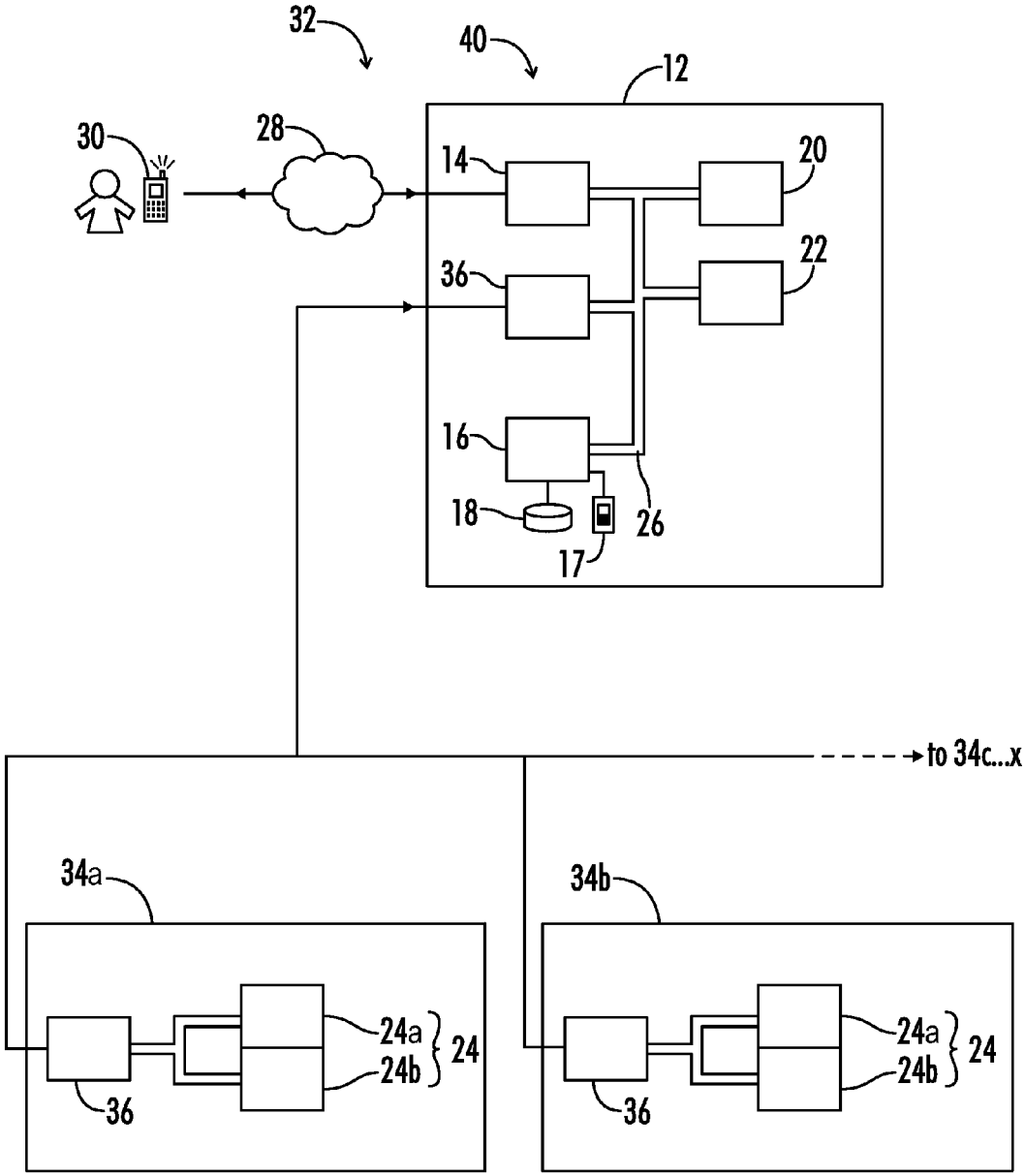
FIG. 4 is a block diagram representing another embodiment of a system in accordance with the present invention.

Referring to FIG. 4, in another embodiment an intermediate device 40 may be provided to receive display data strings via the cellular network 28, to decode the data strings, to determine an intended one or more devices from the string to display an embedded message and to route the embedded message or alternatively the entire data string accordingly. In this case the various devices 34 will each be slave devices in that none of them are connected directly to the cellular network, and may each be interchangeable with each other as no master display device is programmed into the system.

Referring generally to FIGS. 2-4, the devices 10, 34 may in various related embodiments include distinct device addresses such that the remote source 30 may be able to select a particular device to display a particular message, and the associated controllers 16 for each device may therefore be configured to decode the data strings and determine whether the included message is intended for display on the device. The remote devices 10, 34, 40 may be configured to support all levels of frequency operations, and may therefore adapt to existing equipment such as cell towers and radio transmitters which are currently in place.

The remote display devices 10, 34 may in an embodiment include radio transceivers with USB support (or equivalent) such that a user may bypass the main operating system and directly install applications.

The previous detailed description has been provided for the purposes of illustration and description. Thus, although there have been described particular embodiments of the present invention of a new and useful "Multifunction Traffic Control and Information System," it is not intended that such references be construed as limitations upon the scope of this invention except as set forth in the following claims.

What is claimed is:

1. A device comprising:

a housing;

one or more external condition sensors;

one or more display portions integral to the housing and effective to display alphanumeric messages;

a cellular communications module residing within the housing and functionally linked to a cellular network; and a controller residing within the housing and operatively linked to the one or more sensors, the one or more display portions, and the communications module, the controller effective to generate a return data string based on external condition data sensed by the one or more sensors;

transmit said return data string across the cellular network via the communications module;

receive a display data string transmitted from across the cellular network via the communications module, the display data string further comprising an encoded alphanumeric message displayable by at least one of said one or more display portions;

decode said encoded alphanumeric message;

determine whether a message intended for display on one or more display portions has been received via the cellular network;

depending on the determination whether a message intended for display has been received, to further determine at least one of said one or more display portions to either display the decoded message or one or more messages based on the external condition data; and route said decoded message or said one or more messages based on the external condition data to the at least one display portion.

2. The device of claim 1, the controller further effective to compare external condition data sensed by the one or more sensors to a predetermined threshold value, and to visually modify one or more displayed messages based on the comparison.

3. The device of claim 1, further comprising one or more multi-position switches residing within the housing, each switch associated with at least one of the display portions, the controller further effective to determine a first or second switch state for each of the one or more switches, to route a predetermined message to a display portion when the associated switch is in a first state, and to route messages in a received display data string to the display portion when the associated switch is in a second state.

4. The device of claim 3, the controller further effective upon receiving a display data string comprising an address associated with a switch in a second state to generate a return data string identifying the display portion associated with the switch as being locked, and transmit said return data string across the cellular network via the communications module.

5. The device of claim 1, further comprising a power supply residing within the housing and effective to supply power to one or more of the controller, the display portions, the sensors and the communications module, and a power supply terminal coupled to the power supply and effective to receive charging power for the power supply from a power source.

6. The device of claim 5, the power source comprising an array of solar cells coupled to the housing.

7. A system comprising:

one or more external condition sensors;

a plurality of devices each comprising one or more display portions effective to display alphanumeric messages and a local communications module functionally linked to a local network;

at least a first device comprising a master device, the remaining one or more of the plurality of devices comprising slave devices effective to exchange data with the master device via the local network, the first device further comprising a remote communications module functionally linked to a cellular network and a controller operatively linked to the one or more sensors, the one or more display portions, and the local and remote communications module, the controller effective to generate a return data string based on external condition data sensed by the one or more sensors;

transmit said return data string across the cellular network via the remote communications module;

receive an encoded display data string transmitted from across the cellular network via the remote communications module, the display data string further comprising an address associated with one or more of said plurality of devices and a message displayable by said one or more of said plurality of devices;

decode said message and address;

determine whether a message intended for one or more devices for display on associated display portions has been received via the cellular network;

depending on said determination of whether a message intended for one or more devices has been received, to further determine at least one of said one or more devices to display either of the decoded message or one or more messages based on external condition data; and route either of said decoded message or one or more messages based on external condition data to at least one display portion associated with the one or more determined devices.

8. The system of claim 7, the controller of the master device effective to transmit data via the local network to each of the slave devices having a collective address in a single transaction.

9. The system of claim 7, the controller of the master device effective to transmit data via the local network to individual slave devices associated with a unique address.

10. The system of claim 7, the controller further effective to compare external condition data sensed by the one or more sensors to a predetermined threshold value, and to visually modify one or more messages being displayed on one or more devices based on the comparison.

11. The system of claim 7, at least the master device further comprising one or more multi-position switches associated with one or more of the devices and at least one display portion associated with said one or more devices, the controller further effective to determine a first or second switch state for each of the one or more switches, to route a predetermined message to a device when the associated switch is in a first state, and to route messages in a received display data string to the device when the associated switch is in a second state.

12. The system of claim 11, the controller further effective upon receiving a display data string comprising an address associated with a switch in a second state to generate a return data string identifying the device having the display portion associated with the switch as being locked, and transmit said return data string across the cellular network via the remote communications module.

13. A system comprising:

one or more external condition sensors;

a plurality of slave devices each comprising one or more display portions effective to display alphanumeric messages and a local communications module functionally linked to a local network;

a master device comprising a local communications module functionally linked to the local network, a remote communications module functionally linked to a cellular network and a controller operatively linked to the one or more sensors, the controller effective to generate a return data string based on external condition data sensed by the one or more sensors;

transmit said return data string across the cellular network via the remote communications module;

receive a display data string transmitted from across the cellular network via the remote communications module, the display data string further comprising an address associated with one or more of said plurality of slave devices and a message intended for said devices; and transmit said message to the one or more slave devices associated with the address.

14. The system of claim 13, the master device further comprising one or more multi-position switches associated with one or more of the slave devices, respectively, and at least one display portion associated with said one or more devices, the controller further effective to determine a first or second switch state for each of the one or more switches, to route a predetermined message to a slave device when the associated switch is in a first state, and to route messages in a received display data string to the slave device when the associated switch is in a second state.

15. A device comprising:

a housing;

one or more external condition sensors;

one or more display portions integral to the housing and effective to display alphanumeric messages;

a cellular communications module residing within the housing and functionally linked to a cellular network;

one or more multi-position switches residing within the housing, each switch associated with at least one of the display portions; and a controller residing within the housing and operatively linked to the one or more sensors, the switches, the one or more display portions, and the communications module, the controller effective to generate a return data string based on external condition data sensed by the one or more sensors;

transmit said return data string across the cellular network via the communications module;

receive an encoded display data string transmitted from across the cellular network via the communications module, the display data string further comprising an alphanumeric message displayable by at least one of said one or more display portions;

decode the encoded alphanumeric message;

determine a first or second switch state for each of the one or more switches;

route a predetermined message to a display portion when the associated switch is in a first state; and route decoded messages from a received data string to the display portion when the associated switch is in a second state.

16. The device of claim 15, the controller further effective upon receiving a display data string comprising an address associated with a switch in a second state to generate a return data string identifying the display portion associated with the switch as being locked, and transmit said return data string across the cellular network via the communications module.

17. The device of claim 15, the controller further effective to determine whether a message has been received by the cellular network, and depending on the determination to route either the received message or one or more messages based on external condition data when the switch is in a second state.

18. A system comprising:

one or more external condition sensors;

a plurality of devices comprising a master device and one or more slave devices effective to exchange data with the master device via a local communications module functionally linked to a local network, each of the plurality of devices comprising one or more display portions effective to display alphanumeric messages;

the master device further comprising a remote communications module functionally linked to a cellular network, one or more multi-position switches associated with one or more of the devices, and a controller operatively linked to the sensors, switches, display portions, and the local and remote communications module, the controller effective to generate a return data string based on external condition data sensed by the one or more sensors;

transmit said return data string across the cellular network via the remote communications module;

receive a display data string transmitted from across the cellular network via the remote communications module, the display data string further comprising a message displayable by one or more of said plurality of devices;

determine a first or second switch state for each of the one or more switches;

route a predetermined message to a device when the associated switch is in a first state; and route messages in a received display data string to the device when the associated switch is in a second state.

19. The system of claim 18, the controller further effective upon receiving a display data string comprising an address associated with a switch in a second state to generate a return data string identifying the device having the display portion associated with the switch as being locked, and transmit said return data string across the cellular network via the remote communications module.

20. The system of claim 18, the controller further effective to determine whether a message has been received by the cellular network, and depending on the determination to route either the received message or one or more messages based on external condition data when the switch is in a second state.

* * * * *

UNITED STATES PATENT AND TRADEMARK OFFICE
Certificate

Patent No. 8,570,189 B1 Patented: October 29, 2013

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Eric Casebolt, Tullahoma, TN (US); Dennis William Dormady, Jacksonville, FL (US); and Stephen M. Obsharsky, Jacksonville, FL (US).

Signed and Sealed this Twenty-fifth Day of November 2014.

GEORGE A. BUGG
*Supervisory Patent Examiner*
Art Unit 2682
Technology Center 2600